US008940679B2

(12) United States Patent
Jabrane

(10) Patent No.: US 8,940,679 B2
(45) Date of Patent: Jan. 27, 2015

(54) CLEANING AND DEODORIZING COMPOSITIONS AND METHODS

(71) Applicant: Pollet S.A., Tournai (BE)

(72) Inventor: Abdelhamid Jabrane, Beersel (BE)

(73) Assignee: Pollets S.A., Tournai (BE)

( * ) Notice: Subject to any disclaimer, the term of this patent is extended or adjusted under 35 U.S.C. 154(b) by 0 days.

(21) Appl. No.: 13/750,095

(22) Filed: Jan. 25, 2013

(65) Prior Publication Data

US 2014/0213500 A1 Jul. 31, 2014

(51) Int. Cl.

| | |
|---|---|
| ***C11D 17/00*** | (2006.01) |
| ***C11D 3/10*** | (2006.01) |
| ***C11D 3/12*** | (2006.01) |
| ***C11D 3/50*** | (2006.01) |
| ***B08B 7/00*** | (2006.01) |
| ***B08B 9/00*** | (2006.01) |
| ***B08B 9/02*** | (2006.01) |
| ***C11D 1/14*** | (2006.01) |
| ***C11D 3/00*** | (2006.01) |
| ***C11D 3/20*** | (2006.01) |
| ***C11D 3/38*** | (2006.01) |

(52) U.S. Cl.

CPC ..... *C11D 17/0047* (2013.01); *C11D 1/146* (2013.01); *C11D 3/0052* (2013.01); *C11D 3/0068* (2013.01); *C11D 3/10* (2013.01); *C11D 3/2086* (2013.01); *C11D 3/381* (2013.01); *C11D 3/50* (2013.01); *C11D 17/0073* (2013.01)

USPC ..... 510/446; 510/191; 510/194; 510/195; 510/196; 510/461; 510/477; 510/478; 510/495; 510/509; 510/511; 134/22.11; 134/22.14; 134/22.19; 134/42

(58) Field of Classification Search

CPC ..... C11D 17/0047; C11D 17/0056; C11D 17/0073; C11D 3/0052; C11D 3/0068; C11D 3/10; C11D 1/146; C11D 3/2082; C11D 3/381; C11D 3/50

USPC ..... 510/191, 194, 195, 196, 446, 461, 495, 510/509, 477, 478, 511; 134/22.11, 42

See application file for complete search history.

(56) References Cited

U.S. PATENT DOCUMENTS

| | | | | |
|---|---|---|---|---|
| 4,994,266 | A * | 2/1991 | Wells | 424/76.7 |
| 5,043,090 | A * | 8/1991 | Camp et al. | 510/192 |
| 6,350,607 | B1 * | 2/2002 | Cooney, Jr. | 435/262.5 |
| 6,387,874 | B1 * | 5/2002 | Schalitz et al. | 510/530 |
| 2006/0293212 | A1 * | 12/2006 | Griese et al. | 510/446 |
| 2009/0105111 | A1 * | 4/2009 | Stolte et al. | 510/392 |
| 2009/0263884 | A1 * | 10/2009 | Mehta | 435/252.1 |

* cited by examiner

*Primary Examiner* — Lorna M Douyon

(74) *Attorney, Agent, or Firm* — Knobbe, Martens, Olson & Bear LLP

(57) ABSTRACT

The present invention relates to compositions for deodorizing and cleaning, in particular solid compositions in the form of effervescent tablets which can be reconstituted in water to obtain solutions for cleaning and deodorizing. The compositions comprise one or more *Bacillus subtilis* strain(s), one or more surfactant(s), one or more fragrance(s), one or more descaling agent(s), and one or more effervescent agent(s). The invention further relates to a kit comprising such tablets, as well as methods for obtaining cleaning and deodorizing tablets and solutions and their use for cleaning and deodorizing.

10 Claims, No Drawings

CLEANING AND DEODORIZING COMPOSITIONS AND METHODS

FIELD OF THE INVENTION

The present invention relates to compositions for deodorizing and cleaning, in particular solid compositions in the form of effervescent tablets which can be reconstituted in water to obtain solutions for cleaning and deodorizing, as well as a kit comprising such tablets. The present invention further relates to methods for obtaining cleaning and deodorizing tablets and solutions and their use for cleaning and deodorizing.

BACKGROUND OF THE INVENTION

Odour control represents a major challenge in for instance sanitary installations, such as urinals and toilets, and waste disposal installations, such as drains, pipes and waste bins or garbage storage and disposal sites. Odours originate from a wide variety of both organic and inorganic compounds or substances. Malodours generally originate from volatile molecules containing a wide range of functional groups, such as sulphides, mercaptans, thioesters, acids, esters, amines, aldehydes and ketons, each associated with characteristic odours. A significant fraction of malodours are generated by microbial fermentation processes, resulting in the generation and release of such volatile components.

Numerous methods and products exist to date for controlling odours. A lot of the available products are however not very convenient in use and multiple different products may need to be combined for sequential use, in order to efficiently control odours. In addition, the available products for the most part rely on for instance the use of biocides, in order to eliminate malodour producing microorganisms, resulting in non-environmentally friendly applications. Moreover, available products often merely address the consequences of malodours by masking the malodours, rather than to eliminate the source of malodours.

In view hereof, there remains a need in the art to provide improved methods and products for controlling and eliminating malodours. It is an object of the invention to provide such products and methods, which solve at least part of the shortcomings of the existing products and methods.

SUMMARY OF THE INVENTION

The present invention relates to methods and products for controlling and eliminating malodours. The products and methods according to the invention advantageously combine the aspects of deodorization as well as cleaning by using compositions combining malodour eliminating constituents as well as cleaning constituents.

In an aspect, the present invention relates to a solid dosage form, preferably a tablet, for deodorizing and cleaning comprising:

(i) one or more *Bacillus subtilis* strain(s);
(ii) one or more surfactant(s);
(iii) one or more fragrance(s);
(iv) one or more descaling agent(s); and
(v) one or more effervescent agent(s).

The inventors have surprisingly found that the above listed components can be combined in a single solid composition such as a tablet. It has been previously thought that the above listed components could not be combined in a single solid dosage form, such as a tablet, especially given the fact that the constituents are concentrated in a solid dosage form, compared to a reconstituted liquid dosage form. Furthermore, the above listed components unexpectedly act in a synergistic manner to deodorize and clean. Advantageously, such solid dosage form, in particular a tablet, is effervescent and can conveniently and quickly be reconstituted in water to obtain a liquid cleaning and deodorizing solution. The solid dosage form advantageously allows the cleaning and deodorizing product according to the invention to be formulated such as to occupy a minimal volume, thereby being cost effective with regards to transportation costs. Moreover, while the solid dosage form according to the invention is to be preferably reconstituted in a predetermined amount of water, higher or lower concentrations can be obtained, thereby advantageously increasing flexibility of use of the solid dosage form according to the invention, e.g. for treating heavily versus mildly contaminated areas. Therefore, the solid dosage form according to the invention is characterized by its extreme ease of use, its flexibility of use, and its unprecedented quality of use, underlying which is the unexpected synergistic action of the constituents as well as the advantageous combination of both cleaning and deodorizing constituents.

In an embodiment, the solid dosage form, preferably a tablet, comprises between $10^6$ and $10^{11}$ cfu of said one or more *Bacillus subtilis* strain(s), preferably $10^9$ cfu of said one or more *Bacillus subtilis* strain(s). The tablet is preferably of the size, dimensions and/or weight as described herein elsewhere. Accordingly, in an embodiment, the solid dosage form, preferably a tablet of 4 g, comprises between $10^6$ and $10^{11}$ cfu of said one or more *Bacillus subtilis* strain(s), preferably $10^9$ cfu of said one or more *Bacillus subtilis* strain(s). Alternatively, in an embodiment, the solid dosage form, preferably a tablet, comprises between $10^6$ and $10^{11}$ cfu of said one or more *Bacillus subtilis* strain(s), preferably $10^9$ cfu of said one or more *Bacillus subtilis* strain(s) per 4 g of solid dosage form. The inventors have found that the *Bacillus* strains as described herein are effective in occupying the treated space and thus preventing infiltration, establishment, and/or propagation of deleterious microorganisms which produce components responsible for generating malodours. On the other hand, the *Bacillus* strains as described herein produce a variety of enzymes which are capable of attacking the source of the malodour, by enzymatically processing (i.e. digesting) the malodour causing compounds.

In another embodiment, said one or more fragrance is based on mint, preferably on DL-menthol, delta p-mentha-1(6),8-dien-2-one, p-menthan-3-one and R-p-Mentha-1,8 diene. In an embodiment, the solid dosage form, preferably a tablet, comprises between 2 and 10 wt % of said one or more fragrance(s), preferably 7 wt % of said one or more fragrance(s). The inventors have surprisingly and contrary to expectations found that the fragrance as described herein can be provided in the solid dosage form according to the invention, preferably a tablet, in such high concentrations. It was indeed not expected that liquid fragrances could be provided in concentrations above 2 wt % in solid dosage forms, in particular tablets. The provision of a fragrance in the solid dosage form according to the invention, such as a tablet, advantageously and synergistically aids in eliminating and controlling malodours. A fragrance moreover provides a very fast, almost instantaneous, effect on odour control.

In a further embodiment, said one or more surfactant(s) is an alkyl sulfate, preferably sodium lauryl sulphate. In an embodiment, the solid dosage form, preferably a tablet, comprises between 0.1 and 5 wt % of said one or more surfactant(s), preferably 4 wt % of said one or more surfactant(s). The provision of a surfactant in the solid dosage form according to the invention, such as a tablet, advantageously aids in the cleaning function, such as degreasing, of the compositions as described herein.

In yet another embodiment, said one or more descaling agent(s) is an organic acid, preferably citric acid. In an embodiment, the solid dosage form, preferably a tablet, comprises between 1 and 50 wt % of said one or more descaling agent, preferably 40 wt % of said one or more descaling agent(s). The provision of a descaling agent in the solid dosage form according to the invention, such as a tablet, advantageously and synergistically aids in eliminating and controlling malodours and in addition aids in the cleaning function, such as to remove solid deposits such as resulting from calcification. Without wishing to be bound by theory, it is believed that malodour causing compounds may be trapped in or otherwise associated with such solid deposits and that application of a descaling agent in addition to descaling may further allow improving the efficiency of the remaining malodour eliminating constituents in the solid dosage compositions as described herein.

In another embodiment, said one or more effervescent agent(s) is a mixture that releases carbon dioxide when in contact with water, preferably a mixture comprising citric acid and sodium bicarbonate. In an embodiment, the solid dosage form, preferably a tablet, comprises between 40 and 95 wt % of said one or more effervescent agent(s), preferably 65 wt % of said one or more effervescent agent(s). The use of effervescent agents advantageously allows the very rapid reconstitution of the solid dosage form, such as a tablet, as described herein. In addition, after dissolving, minimal to none manipulation is needed in order to ensure appropriate mixing of the constituents of the solid dosage compositions, in particular tablets, as described herein, such that uniform applications can be assured with the reconstituted aqueous cleaning and deodorizing solutions as described herein.

In a further embodiment, the diameter of the tablet is between 0.3 and 3 cm, preferably 2 cm. In an embodiment, the weight of the tablet is between 1 and 10 g, preferably 4 g. Advantageously, the tablets having the size as described herein can be conveniently dissolved in recipients which are commonly used for applications of solutions as a spray. Furthermore, the weight of the tablets assures a suitably concentrated solid dosage form.

In a further embodiment, the solid dosage form as described herein, preferably a tablet, further comprises other compounds that improve the incorporation of a liquid, preferably the fragrance, in the powder, such as a desiccant, preferably fumed silica, such as Aerosil O. Preferably, these other compounds, such as the desiccant, preferably fumed silica, are present in a concentration between 0.1 and 15 wt %, most preferably between 5 and 10 wt %. The inventors have found that these other compounds, such as a desiccant, preferably fumed silica, advantageously and beneficially affects the physicochemical properties of the solid dosage form as described herein, preferably a tablet, and beneficially interacts with the other components of the solid dosage form as described herein, preferably a tablet, such that for instance optimal dissolution, fragrance release, etc. can be obtained.

It is to be understood that not only the specific combination of the above indicated ingredients of the solid dosage form as described herein, i.e. *Bacillus subtilis,* effervescent agent, surfactant, descaling agent, fragrance, and optionally other compounds that improve the incorporation of a liquid, preferably the fragrance, such as a desiccant, in particular fumed silica, is unprecedented, but also in particular the specific concentrations of each of the ingredients, also relative to each other, is unprecedented and provides for a solid dosage form with superior deodorizing and cleaning properties and physicochemical properties, among which the ability to be formed into a compact tablet.

In another aspect, the invention relates to a method for preparing a deodorizing and cleaning solution, comprising the step of dissolving the solid dosage form, preferably a tablet, as described herein in water.

In an embodiment, the invention relates to the method for deodorizing and cleaning as described herein, comprising the step of applying the solid dosage form, preferably a tablet, as described herein or the solution obtained by dissolving the solid dosage form, preferably a tablet, as described herein on or in an item to be deodorized and cleaned.

In a further aspect, the invention relates to the use of the solid dosage form, preferably a tablet, as described herein or the solution obtained by dissolving the solid dosage form, preferably a tablet, as described herein for deodorizing and cleaning.

In yet another aspect, the invention relates to a kit comprising the solid dosage form, preferably a tablet, as described herein and a recipient for dissolving the solid dosage form, preferably a tablet, in a sufficient amount of water to reconstitute a deodorizing and cleaning solution.

The above and further aspects and preferred embodiments of the invention are described in the following sections and in the appended claims. The subject matter of appended claims is hereby specifically incorporated in this specification.

DETAILED DESCRIPTION OF THE INVENTION

As used herein, the singular forms "a", "an", and "the" include both singular and plural referents unless the context clearly dictates otherwise.

The terms "comprising", "comprises" and "comprised of" as used herein are synonymous with "including", "includes" or "containing", "contains", and are inclusive or open-ended and do not exclude additional, non-recited members, elements or method steps. It will be appreciated that the terms "comprising", "comprises" and "comprised of" as used herein comprise the terms "consisting of", "consists" and "consists of", as well as the terms "consisting essentially of", "consists essentially" and "consists essentially of".

The recitation of numerical ranges by endpoints includes all numbers and fractions subsumed within the respective ranges, as well as the recited endpoints.

The term "about" or "approximately" as used herein when referring to a measurable value such as a parameter, an amount, a temporal duration, and the like, is meant to encompass variations of +/−20% or less, preferably +/−10% or less, more preferably +/−5% or less, and still more preferably +/−1% or less of and from the specified value, insofar such variations are appropriate to perform in the disclosed invention. It is to be understood that the value to which the modifier "about" or "approximately" refers is itself also specifically, and preferably, disclosed.

Whereas the terms "one or more" or "at least one", such as one or more or at least one member(s) of a group of members, is clear per se, by means of further exemplification, the term encompasses inter alia a reference to any one of said members, or to any two or more of said members, such as, e.g., any ≥3, ≥4, ≥5, ≥6 or ≥7 etc. of said members, and up to all said members.

All references cited in the present specification are hereby incorporated by reference in their entirety. In particular, the teachings of all references herein specifically referred to are incorporated by reference.

Unless otherwise defined, all terms used in disclosing the invention, including technical and scientific terms, have the meaning as commonly understood by one of ordinary skill in the art to which this invention belongs. By means of further guidance, term definitions are included to better appreciate the teaching of the present invention.

In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to a person skilled in the art from this disclosure, in one or more embodiments. Furthermore, while some embodiments described herein include some but not other features included in other embodiments, combinations of features of different embodiments are meant to be within the scope of the invention, and form different embodiments, as would be understood by those in the art. For example, in the appended claims, any of the claimed embodiments can be used in any combination.

Disclosed herein is a solid dosage form, preferably a tablet, for deodorizing and cleaning comprising:

(i) one or more *Bacillus subtilis* strain(s);
(ii) one or more surfactant(s);
(iii) one or more fragrance(s);
(iv) one or more descaling agent(s); and
(v) one or more effervescent agent(s).

It is to be understood that according to the invention, the above listed constituents preferably are combined and thus comprised in a single solid dosage form, preferably a tablet.

As used herein, the term "solid dosage form" relates to a solid composition comprising several individual constituents. The constituents in the solid dosage form are present in certain selected concentrations or amounts. It is to be understood that according to the invention, the solid dosage form as described herein is to be reconstituted in a liquid, preferably water, such that a liquid solution, preferably an aqueous solution, is obtained in which the individual constituents are present in certain reconstituted concentrations or amounts. The skilled person will understand that depending on the amount of liquid in which the solid dosage form is reconstituted, more or less concentrated solutions can be obtained. The solid dosage form according to the invention may be any from known in the art, such as without limitation a tablet, capsule, granulate, powder, etc. In a preferred embodiment, the solid dosage form as described herein is a tablet. The skilled person has ample knowledge as to tablet formation. By means of example, tablets may be obtained by compression of the constituents. While the tablet as described herein contain above listed constituents (i) to (v), the skilled person will understand that the tablet may comprise additional constituents, which may or may not be active in deodorization and/or cleaning. Examples of such additional constituents include diluents, fillers, binders or granulating agents, lubricants for aiding in compression, dyes, chelators, antimicrobial compounds, thickeners, desiccants, abrasives, anticaking agents, water softeners, anti-redeposition agents, odor neutralizing and/or masking agents, pH adjusting agents, etc.

In an embodiment, the solid dosage form according to the invention is a tablet having a cylindrical shape. In an embodiment, the tablet, preferably cylindrical, has a surface diameter of between about 0.3 and 3 cm, such as 0.3, 0.5, 0.75, 1, 1.25, 1.5, 1.75, 2, 2.25, 2.5, 2.75, or 3 cm; preferably between about 1 and 2.5 cm, most preferably 2 cm or about 2 cm. The tablet may also have an irregular shape or volume, or for instance also generally be oblong with a polygonal surface. It will be understood that the listed dimensions, i.e. the surface diameter, can also apply to such shapes. As used herein, particular diameter of a polygonal surface refers to the maximum diameter.

In another embodiment, the solid dosage form according to the invention, preferably a tablet, has a weight of between about 1 and 10 gram, such as 1, 2, 3, 4, 5, 6, 7, 8, 9; or 10 gram; preferably between about 2 and 8 gram, more preferably between about 3 and 5 gram, most preferably 4 gram or about 4 gram.

The solid dosage form, preferably a tablet, as described herein, is to be used for deodorization and cleaning. As used herein, "deodorization" refers to reducing or eliminating malodours, i.e. odours typically appreciated as having a bad smell. As used herein, "cleaning" refers to partial or complete removal or decomposition of undesired substances on or in an item to be cleaned, such as in particular, organic matter or scale (calcium) deposits.

The solid dosage form according to the invention, preferably a tablet, comprises at least one strain of *Bacillus subtilis*. *Bacillus subtilis* is a rod-shaped Gram-positive bacterium, and has the ability to form a tough, protective endospore, allowing the organism to tolerate extreme environmental conditions. The inventors have found that *Bacillus subtilis* is particularly suited to be incorporated in the solid dosage forms as described herein. In a preferred embodiment, the *Bacillus subtilis* strains as described herein are present in the solid dosage form according to the invention as spores or endospores. It is to be understood that the *Bacillus subtilis* strain(s) according to the invention is (are) non-pathogenic. At least one *Bacillus subtilis*, preferably (endo)spores thereof, is present in the solid dosage form as described herein. It is known in the art that *Bacillus subtilis* produces and secretes a number of enzymes which are capable of enzymatically processing a variety of compounds, among which several malodour causing or associated compounds. Preferably, the *Bacillus subtilis* strains as described herein are capable of producing and secreting one or more of the following enzymes: protease, esterase, cellulase, lipase, amylase, urease, or xylanase, preferably one or more of protease, cellulase, amylase and lipase, preferably all. In an embodiment, more than one *Bacillus subtilis* strain may be provided in the solid dosage form as described herein, such as different *Bacillus subtilis* stains each producing one or more of the above listed enzymes. By means of example, and without limitation, commercially available *Bacillus subtilis* containing compositions such as the Genzyme series of products (Genesis Biosciences), for example Genzyme Mu may be used. Further *Bacillus subtilis* strains which may be used include one or more of *Bacillus subtilis* with ATCC accession number 202137, 202138, 202139, 6051 (see also U.S. Pat. Nos. 6,140,106 and 5,733,355 in this respect). In an embodiment, the solid dosage form as described herein comprises one or more *Bacillus subtilis* strain, preferably (endo)spores, capable of expressing and/or secreting protease, esterase, cellulase, lipase, amylase, urease, or xylanase, preferably one or more of protease, cellulase, amylase and lipase, preferably all.

Preferably, the one or more strains of *Bacillus subtilis* are present in the solid dosage form according to the invention in an amount of between about $10^6$ and $10^{11}$ cfu (colony forming units), such as $10^6$, $10^7$, $10^8$, $10^9$, $10^{10}$, or $10^{11}$ cfu, preferably between about $10^8$ and $10^{11}$ cfu, more preferably between about $10^9$ and $10^{11}$ cfu. These amounts may relate to the total amounts for all strains combined, but preferably these amounts relate to the amounts per strain. In a preferred embodiment, these amounts relate to amounts for solid dosage forms, preferably tablets having the size and/or weight as described earlier. Hence, in a preferred embodiment, the solid dosage form according to the invention, preferably a tablet, has a diameter of between about 0.3 and 3 cm, a weight of between about 1 and 10 gram, and comprises between about $10^6$ and $10^{11}$ cfu of each *Bacillus subtilis* strain.

The solid dosage form according to the invention, preferably a tablet, further comprises at least one surfactant. Surfactants are well known in the art. By means of further guidance, as used herein, surfactants are amphiphilic molecules, meaning that they contain both hydrophobic groups (tails) and hydrophilic groups (heads). Therefore, a surfactant contains both a water insoluble (or oil soluble) component and a water soluble component. As used herein, surfactants may be detergents, wetting agents, or dispersants. According to the invention, the surfactant may be any known surfactant in the art. In an embodiment, the surfactant is an anionic surfactant. Anionic surfactants contain anionic functional groups at their head, such as sulphate, sulphonate, phosphate, and carboxylates. In an embodiment, the surfactant is a sulphate, sulphonate, or phosphate ester, preferably a sulphate ester. Preferably, the surfactant is an alkyl sulphate. In an embodiment, the surfactant is selected from the group comprising or consisting of ammonium lauryl sulphate and sodium lauryl sulphate, most preferably sodium lauryl sulphate (also called SDS, sodium dodecyl sulphate). In another embodiment, the surfactant is an alkyl-ether sulphate, such as selected from the group comprising or consisting of sodium laureth sulphate (also known as sodium lauryl ether sulfate), and sodium myreth sulphate. in another embodiment, the surfactant is a docusate, such as dioctyl sodium sulfosuccinate, perfluorooctanesulfonate (PFOS), perfluorobutanesulfonate, linear alkylbenzene sulfonates (LABs). In another embodiment, the surfactant is a carboxylate, such as alkyl carboxylates (soaps), for instance sodium stearate; sodium lauroyl sarcosinate and carboxylate-based fluorosurfactants such as perfluorononanoate, perfluorooctanoate (PFOA or PFO). In another embodiment, the surfactant is a cationic surfactant, of which the charge can be pH dependent, such as primary, secondary or tertiary amines, for instance octenidine dihydrochloride; or may comprise permanently charged quaternary ammonium cations, such as alkyltrimethylammonium salts, for instance cetyl trimethylammonium bromide (CTAB) or cetyl trimethylammonium chloride (CTAC); cetylpyridinium chloride (CPC); benzalkonium chloride (BAC); benzethonium chloride (BZT); 5-Bromo-5-nitro-1,3-dioxane; dimethyldioctadecylammonium chloride; or dioctadecyldimethylammonium bromide (DODAB). In a further embodiment, the surfactant is a zwitterionic surfactant (i.e. having both cationic and anionic centres attached to the same molecule). The cationic part may be based on primary, secondary, or tertiary amines or quaternary ammonium cations. The anionic part can be more variable and include sulfonates, as in CHAPS (3-[(3-Cholamidopropyl)dimethylammonio]-1-propanesulfonate). Other anionic groups are sultaines illustrated by cocamidopropyl hydroxysultaine; betaines, e.g., cocamidopropyl betaine; phosphates, e.g. lecithin. In another embodiment, the surfactant may be a non-ionic surfactant (i.e. not charged). Many long chain alcohols exhibit some surfactant properties. Prominent among these are the fatty alcohols cetyl alcohol, stearyl alcohol, and cetostearyl alcohol (consisting predominantly of cetyl and stearyl alcohols), and oleyl alcohol. Examples of non-ionic surfactants include polyoxyethylene glycol alkyl ethers (Brij), such as octaethylene glycol monododecyl ether or pentaethylene glycol monododecyl ether; polyoxypropylene glycol alkyl ethers; glucoside alkyl ethers, such as decyl glucoside, lauryl glucoside, or octyl glucoside; polyoxyethylene glycol octylphenol ethers, such as Triton X-100; polyoxyethylene glycol alkylphenol ethers, such as Nonoxynol-9; glycerol alkyl esters, such as glyceryl laurate; polyoxyethylene glycol sorbitan alkyl esters (polysorbate); sorbitan alkyl esters (Spans); cocamide MEA, cocamide DEA; dodecyldimethylamine oxide; block copolymers of polyethylene glycol and polypropylene glycol: Poloxamers; or polyethoxylated tallow amine (POEA).

In an embodiment, the one or more surfactant is present in the solid dosage form, preferably a tablet, in a concentration of between about 0.1 to 5 weight % (wt %), such as 0.1, 0.5, 1, 1.5, 2, 2.5, 3, 3.5, 4, 4.5, or 5 wt %, preferably between about 1 and 5 wt %, more preferably between about 2 and 5 wt %, even more preferably between about 3 and 5 wt %, most preferably 4 wt % or about 4 wt %. These amounts may relate to the total amounts for all surfactants combined, or may relate to the amounts per surfactant.

The solid dosage form according to the invention, preferably a tablet, further comprises at least one fragrance. As used herein, the term "fragrance" refers to an odorant or aromatic compound or mixture of odorants or aromatic compounds. The fragrance may be a perfume. The term fragrance may also relate to for instance plant extracts, such as essential oils, comprising one or more aromatic compounds. As used herein, the fragrance may be a naturally occurring fragrance or may be a synthetic fragrance. It is to be understood that a fragrance as intended herein refers to a compound or mixture of compounds generally accepted as having a pleasant or appealing smell, as opposed to a malodour. The fragrance according to the invention may be of any type known in the art, such as for instance and without limitation esters, linear or cyclic terpenes, aromatic compounds, alcohols, etc. In a preferred embodiment, the fragrance is based on mint, such as peppermint, i.e. the fragrance is based on one or more compounds naturally found in mint/peppermint. Preferably, the fragrance comprises or consists of one or more of DL-menthol, delta p-mentha-1(6),8-dien-2-one, p-menthan-3-one and R-p-Mentha-1,8 diene. In an embodiment, the fragrance is an extract or essential oil of mint, such as peppermint.

In an embodiment, the solid dosage form according to the invention, preferably a tablet, comprises between about 2 and 10 wt % of the one or more fragrance, preferably a mint based fragrance as described earlier, such as 2, 3, 4, 5, 6, 7, 8, 9, or 10 wt %, preferably between about 3 and 9 wt %, between 4 and 8 wt %, between 5 and 8 wt %, between 5 and 7 wt %, between 6 and 8 wt %, or between 7 and 8 wt %. Preferably, the fragrance is present in an amount of 7 wt %, or about 7 wt %. These amounts may relate to the total amounts for all fragrances combined, or may relate to the amounts per fragrance, which in itself may be a mixture, such as an essential oil. In a further embodiment, the fragrance as detailed herein is present in an amount of at least 5.5 wt %, or between about 5.5 and 10 wt %, preferably between 5.5 and 9 wt %, between 5.5 and 8 wt %, or between 5.5 and 7 wt %.

The solid dosage form according to the invention, preferably a tablet, further comprises at least one descaling agent. As used herein, the term "descaling agent" refers to a compound or mixture of compounds which serve the purpose of removing hard deposits from surfaces, in particular calcium containing deposits, but also magnesium containing deposits or other deposits containing other metal cations. Accordingly, the term descaling agent also refers to a decalcifying agent. Descaling agents according to the invention are preferably acids, such as inorganic acids (e.g. nitric acid, hydrofluoric acid, sulphuric acid, or hydrochloric acid) or organic acids (e.g. citric acid, glycolic acid, or formic acid). The descaling agent(s) may complex or sequester cations, in particular metal cations. In an embodiment, the descaling agent is a chelator. The chelator may be a synthetic chelator (for instance EDTA, EGTA, BAPTA) or may be a natural chelator. In a preferred embodiment, the descaling agent is an organic acid, preferably a weak organic acid. In an embodiment, the organic acid is selected from the group comprising or consisting of citric acid, glycolic acid, and formic acid. Preferably the descaling agent is citric acid.

In an embodiment, the solid dosage form according to the invention, preferably a tablet, comprises between about 1 and 60 wt % of the one or more descaling agent, preferably citric acid, such as 1, 5, 10, 15, 20, 25, 30, 35, 40, 45, 50, 55, or 60 wt %, preferably between about 5 to 60 wt %, between about 10 to 60 wt %, between about 20 to 60 wt %, between about 30 to 60 wt %, between about 40 to 60 wt %, between about 50 to 60 wt %, between about 5 to 50 wt %, between about 10 to 50 wt %, between about 20 to 50 wt %, between about 30 to 50 wt %, between about 40 to 50 wt %, between about 5 to 40 wt %, between about 5 to 30 wt %, between about 5 to 20 wt %, between about 5 to 10 wt %, between about 10 to 40 wt %, between about 10 to 30 wt %, between about 10 to 20 wt %, between about 20 to 40 wt %, between about 20 to 30 wt %, or between about 30 to 40 wt %. Most preferably, the one or more descaling agent is present in an amount of between about 20 to 30 wt % or between about 45 to 50 wt %. These amounts may relate to the total amounts for all descaling agents combined, or may relate to the amounts per descaling agent.

The solid dosage form according to the invention, preferably a tablet, further comprises at least one effervescent agent. As used herein, the term effervescent agent relates to a compound or mixture of compounds which result in the generation and release of a gas when administered to a liquid or when in contact with a liquid. Any effervescent agent known in the art may be used according to the invention. Preferably, the effervescent agent in the solid dosage form according to the invention, preferably a tablet, results in the generation and release of $CO_2$ upon administration in a liquid medium, such as water. In an embodiment, the effervescent agent according to the invention comprises an acid and a carbonate salt (e.g. calcium carbonate) or a bicarbonate salt (e.g. sodium bicarbonate), preferably a metal salt, preferably an acid and sodium bicarbonate, an organic acid and a carbonate salt or bicarbonate salt, or an organic acid and sodium bicarbonate. Most preferably, the effervescent agent according to the invention comprises citric acid and sodium bicarbonate.

In an embodiment, the solid dosage form according to the invention, preferably a tablet, comprises between about 40 and 95 wt % of the one or more effervescent agent, preferably a mixture comprising citric acid and sodium bicarbonate, such as 40, 50, 60, 70, 80, 90, or 95 wt %, preferably between about 40 to 90 wt %, between about 40 to 80 wt %, between about 40 to 70 wt %, between about 40 to 60 wt %, between about 40 to 50 wt %, between about 50 to 90 wt %, between about 50 to 80 wt %, between about 50 to 70 wt %, between about 50 to 60 wt %, between about 60 to 90 wt %, between about 60 to 80 wt %, between about 60 to 70 wt %, between about 70 to 90 wt %, or between about 70 to 80 wt %, more preferably between about 60 to 70 wt %, most preferably 65 wt % or about 65 wt %. These amounts may relate to the total amounts for all effervescent agents combined, or may relate to the amounts per effervescent agent. In case of effervescent agents comprising a mixture of compounds, such as citric acid and sodium bicarbonate, the amounts preferably refer to the combination of both compounds. The relative ratios of the individual compounds in such mixture constituting the effervescent agent can be determined based on stoichiometry as is well known in the art, and taking into account the valence of the ions involved. By means of guidance, for effervescent agents based on citric acid and sodium bicarbonate, equimolar amounts of both components may be mixed.

In an embodiment, the descaling agent as described herein may also function as (part of) and effervescent agent as described herein. For instance, an acid, such as an organic acid, for instance citric acid, may function as a descaling agent and also in combination with a carbonate or bicarbonate salt, for instance sodium bicarbonate, as an effervescent agent. It will be understood by the skilled person that the concentrations and amounts of such components having a dual function as described herein may be adapted according to such situation. By means of example, and without limitation, if 20 to 25 wt % of sodium bicarbonate is used, an equimolar amount of citric acid may be used to reconstitute the effervescent agent, and a further 20 to 30 wt % of citric acid may be used as a descaling agent. A solid dosage form according to the invention, preferably a tablet, may therefore as a non-limiting example comprise between about 40 to 55 wt % citric acid. It will be understood that the same principles apply mutatis mutandis when using mixtures of more than one descaling agent/effervescent agent which may be interchangeable.

In an embodiment, the solid dosage form according to the invention, preferably a tablet, comprises between 40 and 97 wt % of descaling agent and effervescent agent combined, such as 40, 41, 45, 50, 55, 60, 65, 70, 75, 80, 85, 90, 95, 96, or 97 wt %, preferably between about 50 to 85 wt %, between about 55 to 80 wt %, 60 to 75 wt %, or 65 to 75 wt %.

In an embodiment, the solid dosage form according to the invention, preferably a tablet, comprises between about 1 and 60 wt % of the one or more descaling agent, preferably citric acid, such as 1, 5, 10, 15, 20, 25, 30, 35, 40, 45, 50, 55, or 60 wt %, preferably between about 5 to 60 wt %, between about 10 to 60 wt %, between about 20 to 60 wt %, between about 30 to 60 wt %, between about 40 to 60 wt %, between about 50 to 60 wt %, between about 5 to 50 wt %, between about 10 to 50 wt %, between about 20 to 50 wt %, between about 30 to 50 wt %, between about 40 to 50 wt %, between about 5 to 40 wt %, between about 5 to 30 wt %, between about 5 to 20 wt %, between about 5 to 10 wt %, between about 10 to 40 wt %, between about 10 to 30 wt %, between about 10 to 20 wt %, between about 20 to 40 wt %, between about 20 to 30 wt %, or between about 30 to 40 wt %; and further comprises between about 40 and 95 wt % of one or more effervescent agent, preferably a mixture comprising citric acid and sodium bicarbonate, such as 40, 50, 60, 70, 80, 90, or 95 wt %, preferably between about 40 to 90 wt %, between about 40 to 80 wt %, between about 40 to 70 wt %, between about 40 to 60 wt %, between about 40 to 50 wt %, between about 50 to 90 wt %, between about 50 to 80 wt %, between about 50 to 70 wt %, between about 50 to 60 wt %, between about 60 to 90 wt %, between about 60 to 80 wt %, between about 60 to 70 wt %, between about 70 to 90 wt %, or between about 70 to 80 wt %, more preferably between about 60 to 70 wt %, most preferably 65 wt % or about 65 wt %; wherein the combined amount of descaling agent and effervescent agent does not exceed 100 wt %, preferably does not exceed 97 wt %, more preferably does not exceed 95 wt %, and is preferably comprised between about 40 and 97 wt % of descaling agent and effervescent agent combined, such as 40, 41, 45, 50, 55, 60, 65, 70, 75, 80, 85, 90, 95, 96, or 97 wt %, preferably between about 50 to 85 wt %, between about 55 to 80 wt %, 60 to 75 wt %, or 65 to 75 wt %.

In an embodiment, the descaling agent is one or more organic acid, preferably citric acid, and the effervescent agent is a mixture of the same or a different organic acid(s) which may also function as a descaling agent, for instance citric acid, and a carbonate or bicarbonate salt, for instance sodium bicarbonate, wherein the weight ratio of organic acid(s) to the carbonate or bicarbonate salt is comprised between about 4 to 1 and 1.1 to 1, preferably comprised between about 3 to 1 and 1.5 to 1, more preferably between about 2.5 to 1 and 1.8 to 1.

In a further embodiment, the solid dosage form as described herein, preferably a tablet, further comprises other compounds that improve the incorporation of a liquid, preferably the fragrance, in the powder, such as desiccants, preferably fumed silica, such as Aerosil O. Preferably fumed silica is present in a concentration between 2 and 15 wt %, most preferably between 5 and 10 wt %, such as for instance 5, 6, 7, 8, 9, or 10 wt %. Other compounds can also achieve the same results like zinc stearate (0.1-1 wt %), sorbitol (1-5 wt %), Polyethylen glycol 6000 (0.1-1 wt %) and Tixosil (6-8 wt %).

Particularly suited solid dosage forms, preferably a tablet, according to the invention comprise the constituents as listed in Tables 1 to 9 in the indicated amounts. Amounts are indicated as weight % (e.g. 45-50 g of citric acid per 100 g of solid dosage form). *Bacillus subtilis* is given in cfu (colony forming units). It will be understood by the skilled person that the combined amounts of the individual constituents does not exceed 100%. Where the combined amounts of the individual constituents amount to less than 100%, the remainder may be made up by for instance fillers, preferably inert fillers, or additional excipients or active substances as described earlier. In view of the interactions between the individual constituents, the concentrations of the constituents in Tables 1 to 8 were found to provide optimal results in respect of cleaning and deodorizing efficacy.

It will be appreciated that in addition to the essential components according to the invention, as listed in Table 1, additional components may be added to the solid dosage form according to the invention, preferably a tablet, as indicated in Tables 2 to 8, and providing additional or complementary functions.

TABLE 1

| Constituent | Amount |
|---|---|
| Citric acid | 45-50 wt % |
| Sodium bicarbonate | 20-25 wt % |
| Surfactant (e.g. sodium lauryl sulphate) | 0.1-5 wt % |
| Fragrance | 5-7 wt % |
| *Bacillus subtilis* | (1-5) × $10^{10}$ cfu/100 g |

TABLE 2

| Constituent | Amount |
|---|---|
| Citric acid | 45-50 wt % |
| Sodium bicarbonate | 20-25 wt % |
| Surfactant (e.g. sodium lauryl sulphate) | 0.1-5 wt % |
| Fragrance | 5-7 wt % |
| Fumed silica (e.g. Aerosil ®) | 5-10 wt % |
| *Bacillus subtilis* | (1-5) × $10^{10}$ cfu/100 g |

TABLE 3

| Constituent | Amount |
|---|---|
| Citric acid | 45-50 wt % |
| Sodium bicarbonate | 20-25 wt % |
| Surfactant (e.g. sodium lauryl sulphate) | 0.1-5 wt % |
| Fragrance | 5-7 wt % |
| Polyethylene glycol 6000 | 0.1-1 wt % |
| *Bacillus subtilis* | (1-5) × $10^{10}$ cfu/100 g |

TABLE 4

| Constituent | Amount |
|---|---|
| Citric acid | 45-50 wt % |
| Sodium bicarbonate | 20-25 wt % |
| Surfactant (e.g. sodium lauryl sulphate) | 0.1-5 wt % |
| Fragrance | 5-7 wt % |
| Polyethylene glycol 6000 | 0.1-1 wt % |
| Fumed silica (e.g. Aerosil ®) | 5-10 wt % |
| *Bacillus subtilis* | (1-5) × $10^{10}$ cfu/100 g |

TABLE 5

| Constituent | Amount |
|---|---|
| Citric acid | 45-50 wt % |
| Sodium bicarbonate | 20-25 wt % |
| Surfactant (e.g. sodium lauryl sulphate) | 0.1-5 wt % |
| Fragrance | 5-7 wt % |
| Polyethylene glycol 6000 | 0.1-1 wt % |
| Fumed silica (e.g. Aerosil ®) | 5-10 wt % |
| Sodium gluconate | 0-5 wt % |
| *Bacillus subtilis* | (1-5) × $10^{10}$ cfu/100 g |

TABLE 6

| Constituent | Amount |
|---|---|
| Citric acid | 45-50 wt % |
| Sodium bicarbonate | 20-25 wt % |
| Surfactant (e.g. sodium lauryl sulphate) | 0.1-5 wt % |
| Fragrance | 5-7 wt % |
| Polyethylene glycol 6000 | 0.1-1 wt % |
| Fumed silica (e.g. Aerosil ®) | 5-10 wt % |
| Bronopol | 0-5 wt % |
| *Bacillus subtilis* | (1-5) × $10^{10}$ cfu/100 g |

TABLE 7

| Constituent | Amount |
|---|---|
| Citric acid | 45-50 wt % |
| Sodium bicarbonate | 20-25 wt % |
| Surfactant (e.g. sodium lauryl sulphate) | 0.1-5 wt % |
| Fragrance | 5-7 wt % |
| Polyethylene glycol 6000 | 0.1-1 wt % |
| Fumed silica (e.g. Aerosil ®) | 5-10 wt % |

TABLE 7-continued

| Constituent | Amount |
|---|---|
| Sodium gluconate | 0-5 wt % |
| Bronopol | 0-5 wt % |
| *Bacillus subtilis* | (1-5) × $10^{10}$ cfu/100 g |

TABLE 8

| Constituent | Amount |
|---|---|
| Citric acid | 45-50 wt % |
| Sodium bicarbonate | 20-25 wt % |
| Surfactant (e.g. sodium lauryl sulphate) | 0.1-5 wt % |
| Fragrance | 5-7 wt % |
| Polyethylene glycol 6000 | 0.1-1 wt % |
| Fumed silica (e.g. Aerosil ®) | 5-10 wt % |
| Sodium gluconate | 0-5 wt % |
| Bronopol | 0-5 wt % |
| *Bacillus subtilis* | (1-5) × $10^{10}$ cfu/100 g |
| Dye | 0.01-0.1 wt % |

The Fumed silica in each of Tables 1 to 8 may be replaced with any other compound which improved the incorporation of a liquid, such as desiccants, in particular the fragrance, into a powder or other solid dosage form, preferably a tablet. Other such compounds include zinc stearate (preferably 0.1-1 wt %), sorbitol (preferably 1-5 wt %), and Tixosil (preferably 6-8 wt %). Polyethylene glycol also has the same effect (preferably 0.1-1 wt %).

The fragrance in each of Tables 1 to 8 may in another embodiment also be present in an amount of 5.5-7 wt %. Particular advantages of such formulations include fast dissolution combined with increased fragrance. These advantages are particularly apparent in formulations according to Tables 2 to 8.

In a further aspect, the invention relates to a method for preparing a deodorizing and cleaning solution, comprising the step of applying or dissolving the solid dosage form as described herein, preferably a tablet, in a liquid. In a preferred embodiment, the liquid is an aqueous medium, preferably water, such as tap water. It will be understood by the skilled person that the solid dosage form as described herein is a concentrate which can be reconstituted by applying or dissolving in a liquid medium, for instance water, to obtain a diluted concentration of the individual constituents which can be used for cleaning and deodorizing. The skilled person will further understand that the amount of liquid in which the solid dosage form as described herein, preferably a tablet, may vary depending on the concentration of the constituents. In an embodiment, the solid dosage form as described herein, in particular a tablet having the diameter and/or weight as described herein, and/or having the concentrations or amounts of the individual constituents as described herein, can be dissolved in between 150 and 1500 ml liquid, preferably water, for instance between 300 and 1200 ml liquid, preferably between 650 and 1000 ml liquid, such as for instance 650, 700, 800, 900, or 1000 ml liquid or about 650, 700, 800, 900, or 1000 ml liquid, to reconstitute a ready-to-use cleaning and deodorizing solution. It will be understood by the skilled person that if needed more diluted or more concentrated reconstituted liquid cleaning and deodorizing solutions may be obtained by applying or dissolving the solid dosage form as described herein, preferably a tablet, in more or less liquid, such as water, or alternatively by applying or dissolving more or less of the solid dosage form as described herein, preferably a tablet, in a given amount of liquid, such as water.

In an embodiment, the pH of the reconstituted cleaning and deodorizing solution is between about 3 and 6, preferably between about 3.5 and 5.5, more preferably between about 4 and 5, most preferably 4.5 or about 4.5.

In another aspect, the invention relates to a method for deodorizing and cleaning, comprising the step of applying the solid dosage form as described herein, preferably a tablet, or the solution obtained by applying or dissolving in a liquid, preferably an aqueous medium, most preferably water, as described above, on or in an item to be deodorized or cleaned. In an embodiment, the invention relates to a method for deodorizing and cleaning an item containing a liquid by applying or dissolving the solid dosage form as described herein, preferably a tablet, in the item containing the liquid. By means of example, and without limitation, the item containing a liquid may be a toilet, a septic tank, a liquid waste collector, etc. or associated connecting drains or pipes. In another embodiment, the invention relates to a method for deodorizing and cleaning an item by applying the reconstituted cleaning and deodorizing solution as described herein on the surface of the item to be cleaned and deodorized. By means of example, and without limitation, such item may be a wall, window or door, a work bench, a garbage bin or waste collector, etc.

In another aspect, the invention relates to the use of the solid dosage form as described herein, preferably a tablet, or the reconstituted solution as described above, for deodorizing and cleaning.

In yet another aspect, the invention relates to a kit comprising the solid dosage form as described herein, preferably a tablet, and a recipient for applying or dissolving the solid dosage form, preferably a tablet, in a sufficient amount of liquid, preferably water, as detailed earlier, to reconstitute a deodorizing and cleaning solution. The size and shape of the recipient to reconstitute the cleaning and deodorizing solution is not particularly relevant. In an embodiment, the recipient is a spray bottle, preferably a spray bottle of sufficient volume to reconstitute one or more solid dosage forms as described herein, preferably a tablet, as a liquid solution.

EXAMPLES

The composition of the solid dosage form according to the invention was optimized. Three different formulations according to the invention were prepared and compared. The different formulations and the concentration of the individual constituents are listed in Table 9. The dissolution time, the pH and the appreciation of the perfume were evaluated. The results are indicated in Table 10.

TABLE 9

| Constituent | Formulation 1 | Formulation 2 | Formulation 3 |
|---|---|---|---|
| Citric acid | 40-45 wt % | 40-45 wt % | 45-50 wt % |
| Sodium bicarbonate | 35-40 wt % | 35-40 wt % | 20-25 wt % |
| Sodium lauryl sulphate | 0.1-5 wt % | 0.1-5 wt % | 0.1-5 wt % |
| Fragrance | 5.5-7 wt % | 4-5.5% | 5.5-7 wt % |
| Polyethylene glycol 6000 | 0.1-1 wt % | 0.1-1 wt % | 0.1-1 wt % |
| Fumed silica (e.g. Aerosil ®) | — | — | 5-10 wt % |
| Sodium gluconate | 0-5 wt % | 0-5 wt % | 0-5 wt % |
| Bronopol | 0-5 wt % | 0-5 wt % | 0-5 wt % |
| *Bacillus subtilis* | (1-5) × $10^{10}$ cfu/100 g | (1-5) × $10^{10}$ cfu/100 g | (1-5) × $10^{10}$ cfu/100 g |
| Dye | 0.01-0.1 wt % | 0.01-0.1 wt % | 0.01-0.1 wt % |

As is clear from Table 10, all three formulations allowed for a compact tablets to be formed.

TABLE 10

| | Formulation 1 | Formulation 2 | Formulation 3 |
|---|---|---|---|
| dissolution time | 40 min 20 sec | 5 min 20 sec' | 6 min 20 sec' |
| pH | 7 | 7 | 4.53 |
| perfume | OK | weak | OK |
| Compact tablet | OK | OK | OK |

It was seen that for Formulation 1 the dissolution time was longer than for Formulations 2 and 3. For Formulation 2 the smell of the perfume was weaker than for Formulations 1 and 3. Formulation 3 represents an optimal formulation, which dissolved fast and had a strong smell of the perfume. Moreover, the pH of Formulation 3 was such that optimal descaling occurred.

The invention claimed is:

1. A tablet for deodorizing and cleaning comprising:

(i) one or more *Bacillus subtilis* strain(s);

(ii) from 0.1-5.0 wt % of one or more surfactant(s)comprising sodium lauryl sulphate;

(iii) from 5.5 to 10 wt % of one or more fragrance(s);

(iv) from 45 to 50 wt % of citric acid;

(v) from 20 to 25 wt % of sodium bicarbonate; and (vi) from 5 to 10 wt % of at least one desiccant comprising fumed silica, wherein the pH of a ready to use solution is between about 3 and 6.

2. The tablet according to claim 1, comprising between $10^6$ and $10^{11}$ cfu of said one or more *Bacillus subtilis* strain(s), preferably $10^9$ cfu of said one or more *Bacillus subtilis* strain (s).

3. The tablet according to claim 1, wherein said one or more fragrance is based on mint, preferably on DL-menthol, delta p-mentha-1(6),8-dien-2-one, p-menthan-3-one and R-p-Mentha-1,8 diene.

4. The tablet according to claim 1, comprising between from 5.5 to 7 wt % of said one or more fragrance(s).

5. The tablet according to claim 1, wherein the diameter of the tablet is between 0.3 and 3 cm, preferably 2 cm.

6. The tablet according to claim 1, wherein the weight of the tablet is between 1 and 10 g, preferably 4 g.

7. A kit comprising the tablet according to claim 1 and a recipient for dissolving the tablet in a sufficient amount of water to reconstitute a deodorizing and cleaning solution.

8. Method for preparing a deodorizing and cleaning solution, comprising the step of dissolving the tablet according to claim 1 in water.

9. Method for deodorizing and cleaning, comprising the step of applying the solution obtained according to claim 8 on or in an item to be deodorized and cleaned.

10. Method for deodorizing and cleaning, comprising the step of applying the tablet according to claim 1 on or in an item to be deodorized and cleaned.

* * * * *

UNITED STATES PATENT AND TRADEMARK OFFICE

CERTIFICATE OF CORRECTION

PATENT NO. : 8,940,679 B2
APPLICATION NO. : 13/750095
DATED : January 27, 2015
INVENTOR(S) : Abdelhamid Jabrane It is certified that error appears in the above-identified patent and that said Letters Patent is hereby corrected as shown below:

ON THE TITLE PAGE

Page 1 (item 73, Assignee) at line 1, Change “Pollets S.A.,” to --Pollet S.A.,--.

IN THE SPECIFICATION

In column 1 at line 25, Change “ketons,” to --ketones,--.

In column 3 at line 48, Change “Aerosil O.” to --Aerosil ®.--.

In column 11 at line 26 (approx.), Change “Aerosil O.” to --Aerosil ®.--.

In column 11 at line 32, Change “Polyethylen” to --Polyethylene--.

Signed and Sealed this
Thirteenth Day of October, 2015

Michelle K. Lee

Michelle K. Lee
*Director of the United States Patent and Trademark Office*